US005799272A

United States Patent [19]

Zhu

[11] Patent Number: 5,799,272

[45] Date of Patent: Aug. 25, 1998

[54] SWITCHED MULTIPLE SEQUENCE EXCITATION MODEL FOR LOW BIT RATE SPEECH COMPRESSION

[75] Inventor: Qinglin Zhu, Santa Clara, Calif.

[73] Assignee: ESS Technology, Inc., Fremont, Calif.

[21] Appl. No.: 673,007

[22] Filed: Jul. 1, 1996

[51] Int. Cl.[6] ..... G10L 3/02

[52] U.S. Cl. ..... 704/223; 704/229

[58] Field of Search ..... 395/2.32, 2.28, 395/2.31, 2.37, 2.38, 2.43, 2.29; 704/223, 219, 222, 228, 229, 234, 238

[56] References Cited

U.S. PATENT DOCUMENTS

| | | | |
|---|---|---|---|
| 4,937,873 | 6/1990 | McAulay et al. | 395/2.74 |
| 5,115,469 | 5/1992 | Taniguchi et al. | 395/2.37 |
| 5,195,137 | 3/1993 | Swaminathan | 395/2.31 |
| 5,432,883 | 7/1995 | Yoshihara | 395/2.28 |
| 5,530,750 | 6/1996 | Akagiri | 395/2.38 X |
| 5,553,191 | 9/1996 | Minde | 395/2.28 |
| 5,596,677 | 1/1997 | Jarvinen et al. | 395/2.38 X |
| 5,602,961 | 2/1997 | Kolesnik et al. | 395/2.28 X |

*Primary Examiner*—David R. Hudspeth
*Assistant Examiner*—Scott Richardson
*Attorney, Agent, or Firm*—Wagner Murabito & Hao

[57] ABSTRACT

An apparatus for compressing a speech signal into a compressed speech signal that is represented by a plurality of parameters. A time-varying digital filter is used to model the vocal tract. A number of LPC coefficients specify the transfer function of the filter updated on frame basis. An excitation signal is input to the filter analyzed on sub frame basis. This excitation signal includes either an adaptive vector quantiser code or a first pulse sequence, followed by a second pulse sequence. Selection logic is used to determine whether the adaptive vector quantiser code or the first pulse sequence better represents the speech signal. Based thereon, a switch selects either the adaptive vector quantiser code or the first pulse sequence. Thus, the parameters which are transmitted through a channel to a destination decoder include the LPC filter coefficients, either the adaptive vector quantiser code or the first pulse sequence, the second pulse sequence, and one bit indicating the state of the switch.

12 Claims, 6 Drawing Sheets

SWITCHED MULTIPLE SEQUENCE EXCITATION MODEL FOR LOW BIT RATE SPEECH COMPRESSION

FIELD OF THE INVENTION

The present invention pertains to speech compression. More particularly, the present invention relates to a switched multiple sequence excitation model for low bit rate speech compression.

BACKGROUND OF THE INVENTION

In the past, speech communications was primarily handled through the use of analog systems, whereby voice or sound waves were used to modulate an electrical signal. The electrical signal was then conveyed either through the airwaves (e.g., radio) or through twisted pairs of copper wires (e.g., telephone). The receiver would then demodulate and amplify the received electrical signal for playback to human listeners.

However, with the advent of computer systems, modern information technology has transitioned into a digital era. Information is processed, stored, and transmitted digitally as a series of bits (i.e., either 1's or 0's). Modems and other types of transceivers are designed to transmit and receive digital information via various mediums, such as local area networks, the Internet, fiber optics, cable, microwaves, Integrated Services Digital Networks (ISDN), satellite communication systems, etc. The same transmission medium is commonly used to carry digitized text, data, video, graphics, email, facsimiles, speech, etc.

One problem associated with digitally encoded speech is that it requires a lot of bandwidth. This is a problem since transmission mediums are physically constrained in the amount of information that they may carry. Digitized speech transmission, in its natural state, would consume much of the transmission medium's bandwidth. If the bandwidth is exceeded, information may be dropped or lost. Because speech or sound occurs in real-time, the consequences might be disconcerting pops, clicks, or glitches. The problem might be so severe that the sound is unrecognizable.

There are several ways to solve bandwidth limitations. One solution is to add additional lines, but this is quite expensive and inconvenient. A more popular, and cost-effective method is to compress the digitized speech signal so that it can be transmitted with less bandwidth. Generally, speech compression schemes analyze the original speech signal, remove the redundancies, and efficiently encode the non-redundant parts of the signal in a perceptually acceptable manner. And although it is very attractive to decrease the PCM bit rate as much as possible, it becomes increasingly difficult to maintain acceptable speech quality as the bit rate falls. As the bit rate falls, acceptable speech quality can only be maintained by: (a) employing very complex algorithms which are difficult to implement in real time even with the new fast processors, or (b) incurring excessive delay which might induce echo control problems elsewhere in the system. Moreover, as the channel capacity is reduced, the strategies for redundancy removal and bit allocation need to be ever more sophisticated. Hence, the goal of speech compression is to minimize bit rates and maximize speech quality without the use of extraordinary amount of processing power.

Many different strategies have been developed for suitably compressing speech for bandwidth restricted applications. The use of low bit rate speech coders has been standardized in many national and international standards.

The most notable and successfully used low bit rate speech coders are RPE-LTP (in full rate GSM), LD-CELP (CCITT G.728), CELP (US Government Federal standard), IMBE (INMARSAT-M standard), CELP/VSELP (in half rate GSM), VSELP (in North American DMR), VSELP (in Japanese DMR), etc. Although the 2.4 kbps LPC vocoder and the 32 kbps ADPCM waveform coder were adopted as Federal (or CCITT) standards (LPC-10 operated since 1977 and ADPCM operated since 1984), the lack of natural speech quality of the LPC vocoder and the high bit rate of 32 kbps ADPCM speech coder make them both incapable of meeting the demands of fast-growing multimedia digital voice communication applications. This leaves a bit rate gap (from about 4 kbps to 16 kbps) of speech coding.

The present invention offers an, efficient, high-quality speech compression technique suitable for low bit rate speech coding. This is accomplished by utilizing a speech model that is highly adaptive to the time-varying behavior of the speech signal so that the limited bit rate can be spent efficiently to represent the most substantial information in the speech. Since this highly adaptive speech model can remarkably handle the compromise among bit rate, complexity and quality, it can be applied to realize speech coding at bit rate as low as 4 Kbps.

SUMMARY OF THE INVENTION

The present invention pertains to an apparatus and method for compressing a speech signal into a small set of parameters for transmission. A time-varying digital filter is used to model the vocal tract. A number of LPC coefficients specify the transfer function of the filter. An excitation signal is input to the filter. This excitation signal includes either an adaptive vector quantiser code (past sequence, PS) or a first pulse sequence (MS0), followed by one or more pulse sequences (MS1–MSn). In the currently preferred embodiment, the MS0–MSn pulse sequences are comprised of a number of equally spaced pulses, whereby a number of bits are used to specify the phase of the first pulse and the amplitudes of each of the pulses. The number of pulses in each sequence may differ from each other with the constraints that the space should be >16 samples and the sequence length is the multiple of the space.

The LPC coefficients are calculated once per frame, whereas the excitation sequence parameters are analyzed on sub frame basis. Usually, one frame contains four sub frames.

Rather than transmitting the PS code for every sub frame, selection logic is used to determine whether the PS or the MS0 pulse sequence is better suited to represent the speech signal. Based thereon, a switch selects either the PS or MS0 signal. Thus, the parameters which are transmitted through a channel to a destination decoder include the LPC filter coefficients per frame, either PS or MS0, the MS1 pulse sequence per sub frame, and at least one bit indicating the state of the switch. If the channel is lightly loaded and there is extra capacity, additional pulse sequences (MS2–MSn) may optionally be transmitted to improve the overall speech quality.

BRIEF DESCRIPTION OF THE DRAWINGS

The present invention is illustrated by way of example, and not by way of limitation, in the figures of the accompanying drawings.

DETAILED DESCRIPTION

Figure 1:
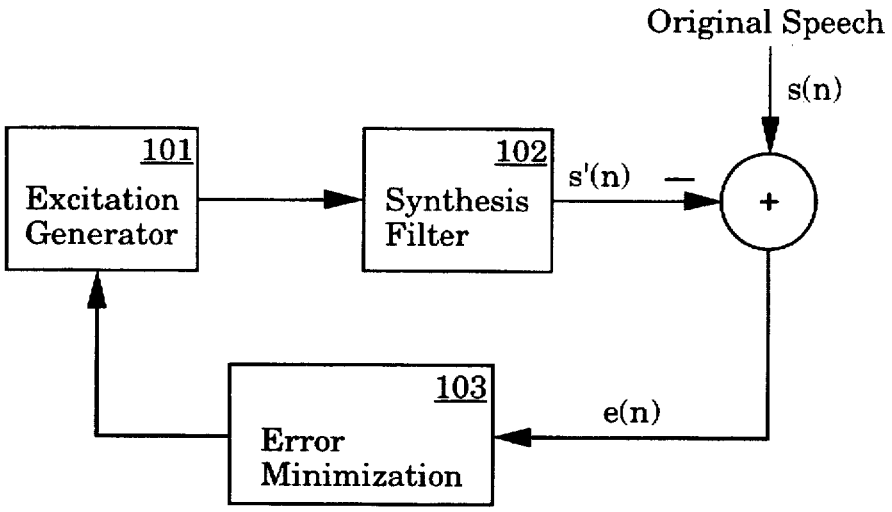
FIG. 1 shows a block diagram of an encoder for compressing speech signals.

A switched multiple sequence excitation model for a low bit rate speech compression mechanism is described. In the following description, for purposes of explanation, numerous specific details are set forth in order to provide a thorough understanding of the present invention. It will be obvious, however, to one skilled in the art that the present invention may be practiced without these specific details. In other instances, well-known structures and devices are shown in block diagram form in order to avoid obscuring the present invention.

According to the Nyquist Theorem, in order to properly digitize an analog signal without losing information, the original signal should be sampled at a rate that is at least twice as high as that of the highest frequency component of the analog signal. For speech, the upper bounds of the human vocal range is approximately 4 kHz. Hence, speech signals must be sampled at a rate of 8,000 samples per second for proper digitization. Given an amplitude range of 8 bits to represent the speech signal at each of the sample points, yields a bit rate of 64,000 bits per second. Consequently, 256 samples would have to be digitized and transmitted for a 32 millisecond frame of data. This would require a bit rate of approximately 2,048/32 msec=64 kbits/sec (kbps).

Speech compression is used to compress the 64 kbps digitized speech into a much lower bit rate, somewhere in the vicinity of just 4 kbps. This is accomplished in the currently preferred embodiment of the present invention by taking an Analysis By Synthesis (ABS) approach based on the switched multiple sequence excitation modeling. Basically, ABS first generates a theoretical model to represent the original speech signal. This model has a number of parameters (for excitation) which can be varied to produce different ranges corresponding to the original speech signal. Next, a trial and error procedure is used to systematically vary the parameters of the model in order to minimize any errors between the synthesized signal and the original speech signal. This error minimization process is repeated until an optimal set of parameters is achieved. These parameters are analyzed and updated on a frame basis (e.g., every 32 msec.). It is these parameters which are digitized and transmitted through a channel to its intended destination. In this manner, 256 samples of a frame's worth of data can be accurately represented by a small set of parameters or bits as well.

For the ABS scheme to function, there needs to be an encoder that includes the decoder at the transmitting side for encoding the original speech signal into the digitized parameters. On the receiving end, there needs to be a decoder for decoding the transmitted parameters and transforming them into the synthesized speech signal for playback. FIG. 1 shows a block diagram of an encoder for compressing speech signals. An excitation generator 101 is used to generate an excitation signal that is fed into the synthesis filter 102. By analogy, synthesis filter 102 models the vocal tract, and the excitation signal from excitation generator 101 represents the stimulation to the vocal tract. At the beginning, the LPC coefficients are analyzed per frame. The excitation generator is initialized to some pre-determined state. An error minimization block 103 is used to determine the error between the synthesized signal s'(n) and the original speech signal s(n). A new excitation signal is generated for each sub frame to minimize this error. This closed loop procedure is repeated until the excitation parameters are optimized.

Figure 2:
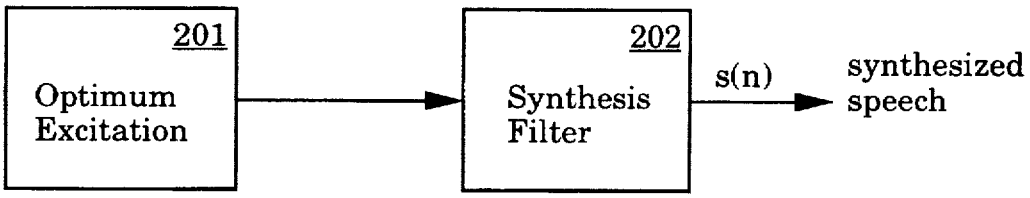
FIG. 2 shows a block diagram of a decoder for decoding transmitted parameters and transforming these parameters to synthesized speech signal.

FIG. 2 shows a block diagram of a decoder for decoding transmitted parameters and transforming these parameters to synthesized speech signal. The received bits that correspond to optimum parameters are decoded by the optimum excitation block 201. The resultant excitation signal is then input to synthesis filter 202. The LPC coefficients are used to control the synthesis filter 202. The output of synthesized filter 202 gives the synthesized speech signal s(n) which can be converted back to its analog form for playback.

In the currently preferred embodiment, the excitation signal is comprised of two components: (1) a past excitation that reflects the long term correlation and (2) multiple pulse sequences where the first sequence MS0 is switched with PS. The past excitation signal (PS) is comprised of an adaptive vector quantiser (VQ) code word as specified by the code-excited LPC (CELP) standard. The LPC and CELP standards are described in detail in the textbook by A. M. Kondoz, *Digital Speech Coding For Low Bit Rate Communication Systems,* John Wiley & Sons, 1994. The second component, the pulse sequences ($MS_0$–$MS_n$), is comprised of a set of equally spaced pulses, wherein the phase or delay of the first pulse and the amplitudes of each of the pulses are determined and digitally encoded. MS0–MSn represent non-correlated innovation information in excitation.

Figure 3:
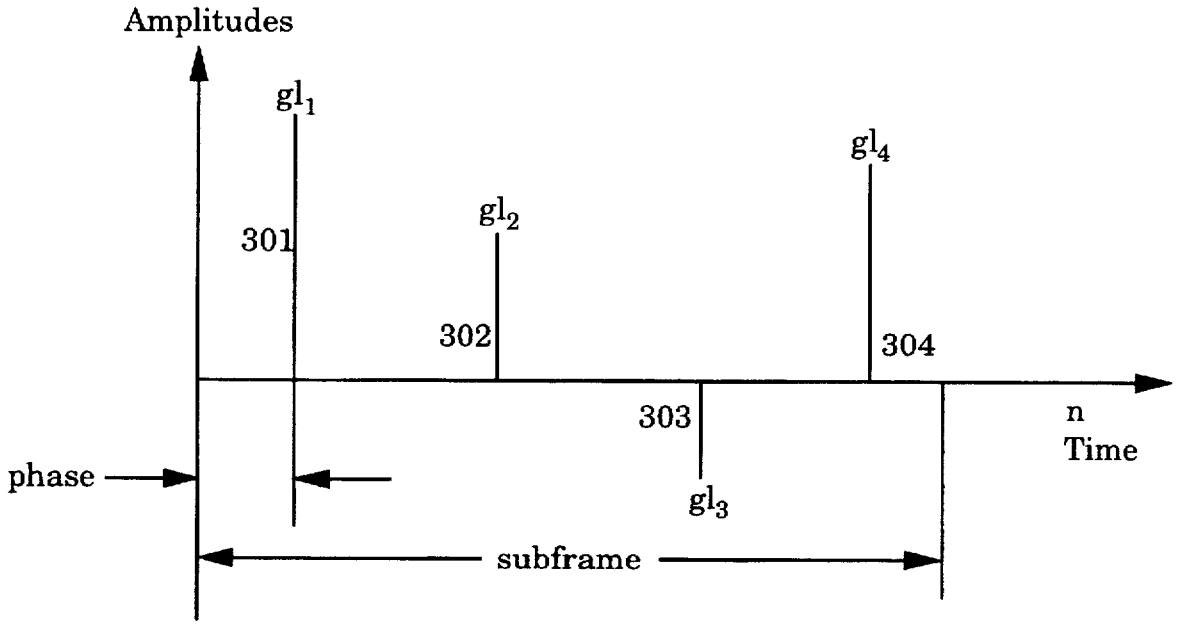
FIG. 3 shows an example of a pulse sequence.

FIG. 3 shows an example of the pulse sequence $MS_0$. The pulse sequence $MS_0$ is comprised of a set of four equally spaced pulses 301–304. Given a subframe of 64 samples at a sampling rate of 8 kHz, the four pulses are spaced 16 samples apart. Due to distantly spaced feature of the pulse sequence, very fast search can be realized. The optimal phase of the first pulse 301 is determined based upon minimum mean-square error (MSE) criterion as follows:

Equation 1:

$$E = \sum_n \left( S_w(n) - \sum_{i=1}^{4} gli\, h[n - \text{phase} - (i-1) * 16] \right)^2$$

Where:

$S_w(n)$ perceptually weighted original speech h(n) impulse response of the filter gli i=1, . . . ,4 pulse amplitudes in MS0 phase initial phase in MS0, here from 0 to 15

At one certain phase value, set partial derivative of E for gl's to zero:

Equation 2:

$$-2 \sum_n \left[ S_w(n) - \sum_{j=1}^{4} glj\, hj(n) \right] h_i(n) = 0 \quad i = 1, \ldots, 4$$

Since li–jl=16 samples or more one can assume $$\sum_n h_i(n) h_j(n) = 0 \quad i \neq j$$

Also, use autocorrelation definition:

$$\sum_n h_i(n)h_j(n) = ph0 = Const \quad i=j$$

In this case, equation (2) can be reduced to

Equation 3:

$$-2\sum_n [(S_w(n) - gli\, h_i(n))h_i(n)] = 0 \quad i=1,\ldots,4$$

From equation 3, the optimal gl:

Equation 4:

$$gli,\ opt = \frac{\sum_n S_w(n)h_i(n)}{ph0} \quad i=1,\ldots,4$$

Where $h_i^{(n)}$=h[n-phase-(i-1)*16]

Substitute equation 2 and equation 4 in equation 1. The optimal $E_{opt}$ is a function of phase as:

Equation 5:

$$\begin{aligned} Eopt &= \sum_n S_w^2(n) - \sum_{i=1}^{4} gli,\ opt \sum_n h_i(n)S_w(n) \\ &= \sum_n S_w^2(n) - \sum_{i=1}^{4} \frac{<S_w h_i>^2}{ph0} \end{aligned}$$

Since the first term in the right hand side of equation 5 is constant, the optimization is to select the phase that maximizes the second term. The optimization is to find the best phase that maximizes the multiple cross correlation sum as:

$$\sum_{i=1}^{4} \frac{<S_w(n)h_i(n)>^2}{ph0}$$

Where:

$$<S_w, h_i> = \sum_n Sw(n)h(n - \text{phase} - (i-1)*16) \quad \text{phase} = 0,\ldots,15$$

Once the optimal phase is determined, the optimal amplitudes gli,opt can be determined from equation 4.

Figure 4:
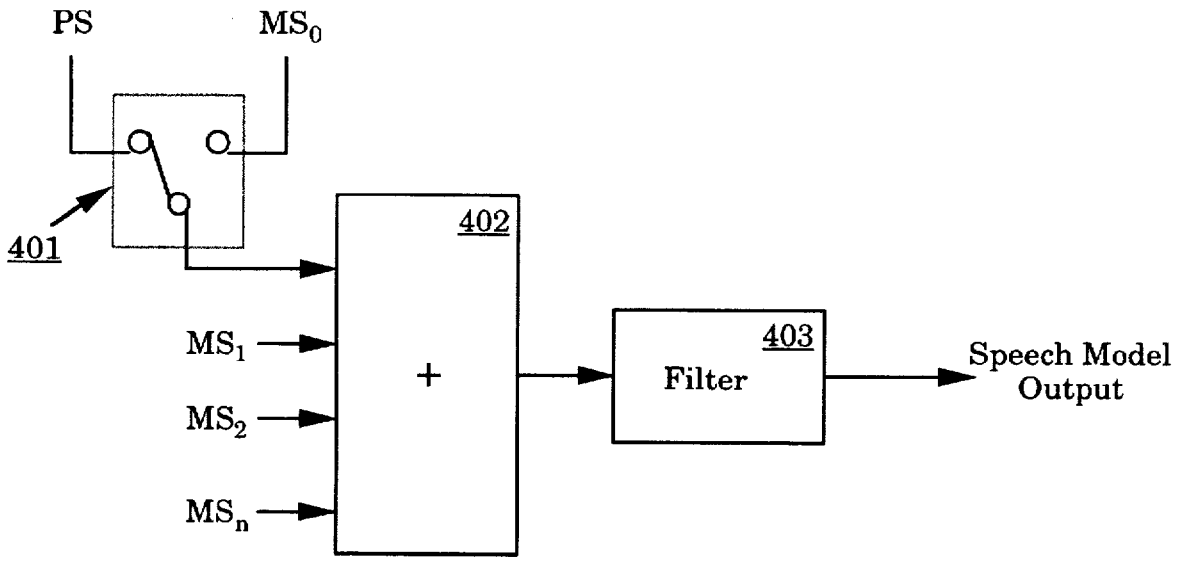
FIG. 4 shows a block diagram of a switched multiple pulse sequence excitation modeling according to the present invention.

FIG. 4 shows a block diagram of a switched multiple pulse sequence excitation modeling according to the present invention. This model is embodied both in decoder and in the ABS of encoder. In the present invention, the adaptive VQ code (PS) is not always transmitted. Instead, a switch 401 is used to select between either the adaptive VQ code (PS) or the first pulse sequence, depending upon which one of the two would result in better voice quality. It has been discovered that sometimes the speech signal has a great deal of periodicity. In those instances, PS significantly contributes to the overall speech quality. However, in other fast time-varying instances, the effect of the PS signal is quite minimal, and it would be a waste of bandwidth to transmit the PS signal. By switching adaptively between past excitation PS and pulse sequence $MS_0$, the excitation model of the present invention best reflects the details in the time-varying portion of the speech signal.

The criterion of switching is based on which sequence can best represent the current excitation of the speech signal. This switching takes place automatically. A single bit is used to convey to the decoder whether the PS or $MS_0$ signal was selected. Combiner block 402 takes the selected signal from switch 401 and combines it with all or part of the other pulse sets $MS_1$–$MS_n$. If the channel is congested, additional bandwidth may be saved by sending only $MS_1$. If bandwidth permits, $MS_2$ may be combined and sent, etc. Thereby, the multiple pulse sequence structure of the present invention allows for variable bit rate coding by an efficient, instant bit manipulation which is a function of the congestion level of the information flow in the transmission channel. In other words, if the channel is congested, the voice quality is degraded gracefully without any disturbing glitches or dropped data. The combined output from combiner block 402 is then input to the filter 403. Filter 403 produces the speech model output.

Figure 5:
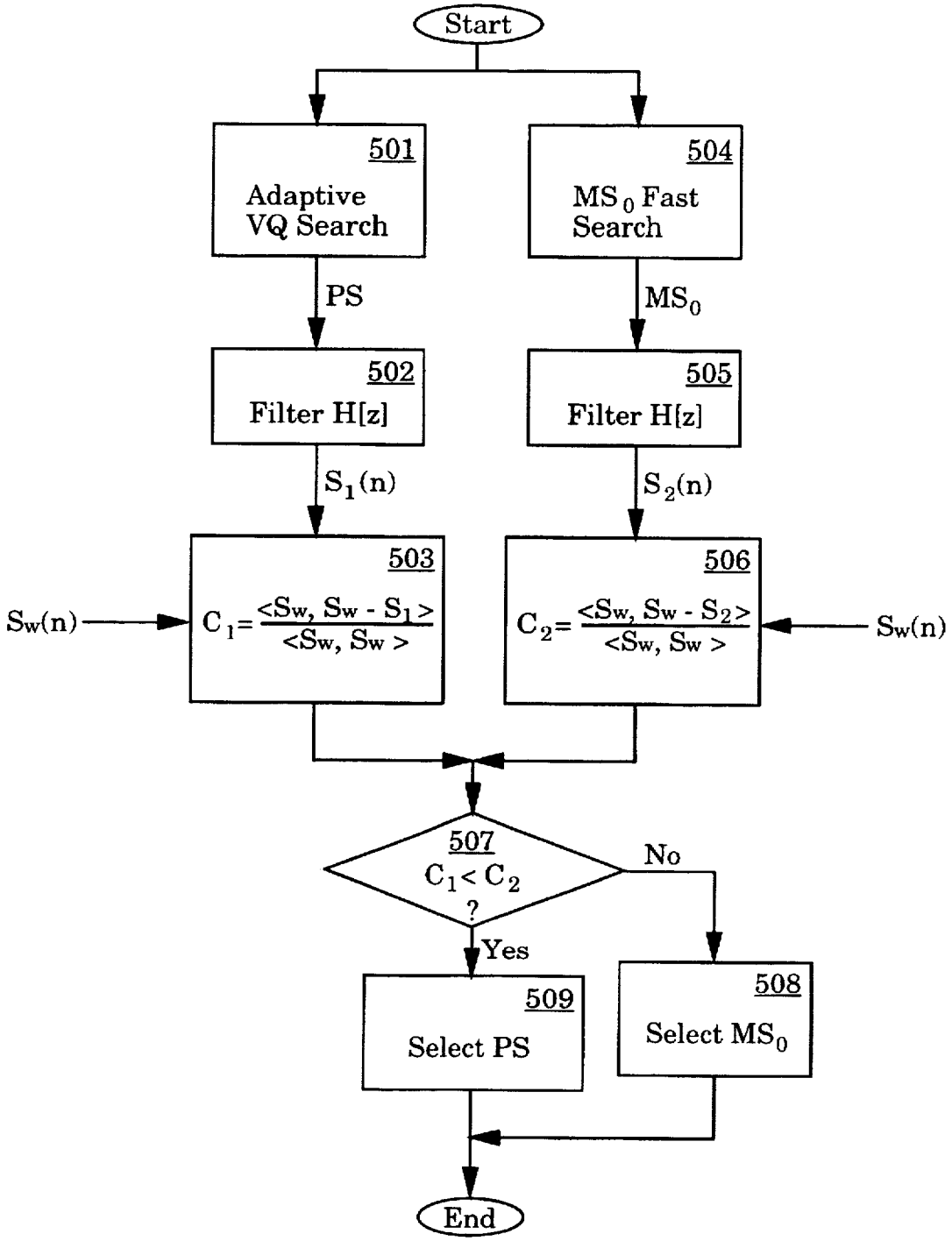
FIG. 5 is a flowchart describing the steps for determining how the switching between PS and $MS_0$ is to be handled.

FIG. 5 is a flowchart describing the steps for determining how the switching between PS and $MS_0$ is to be handled. Initially, an adaptive VQ search is performed in step 501 to determine the past excitation sequence PS. The PS signal is then applied to the filter's transfer function, H[z], to produce $S_1(n)$, step 502. Next, the contribution factor, C1, is calculated for the PS signal based upon the perceptually weighted original speech signal, $S_W$, step 503. Likewise, this process is repeated for the $MS_0$ signal. Namely, a fast search is performed to find $MS_0$ in step 504. The $MS_0$ signal is then applied to the filter's transfer function, H[z], to produce $S_2(n)$, step 505. Next, the contribution factor, $C_2$, is calculated for the $MS_0$ signal based upon the perceptually weighted original speech signal, $S_W$, step 506. The contribution factor, $C_i$, ranges in value from 0 to 1 and is calculated according to the formula:

$$C_i = \frac{\sum_{n=0}^{n_{s-1}} S_w(n)\,(S_w(n) - S_i(n))}{\sum_{n=0}^{n_{s-1}} S_w(n)S_w(n)} \quad i=1,2$$

$S_w$ is the perceptually weighted original speech, ns is the sub frame length. $C_i$ varies from 0 to 1. If $C_i$=0, the $S_i^{(n)}$ is the closest to the $S_w^{(n)}$.

Essentially, the contribution factor is a "closeness" metric, whereby the smaller the contribution factor, the closer it is to the perceptually weighted original speech. The contribution factors, $C_1$ and $C_2$, are compared in step 507 to determine which one is smaller. If $C_1$ is the smaller of the two values, then PS is selected, step 509. Otherwise, $MS_0$ is selected, step 508.

Figure 6:
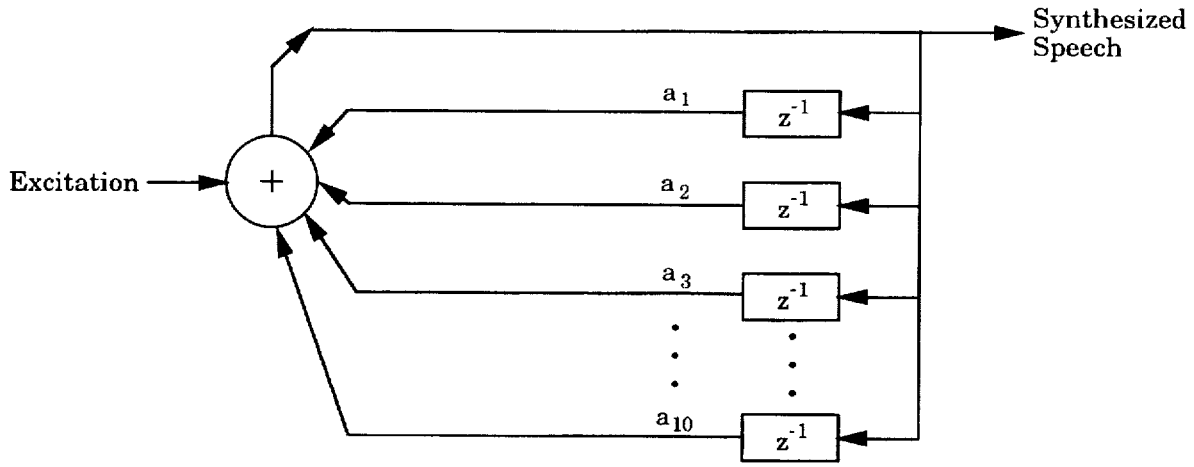
FIG. 6 shows an adaptive, time-varying filter which can be used to model the vocal tract.

FIG. 6 shows an adaptive, time-varying filter which can be used to model the vocal tract. In the currently preferred embodiment, filter 601 is a tenth order, infinite impulse response LPC filter. The filter is controlled by ten LPC coefficients denoted by $a_i$, where i=1 to 10. These LPC coefficients per frame are one of the parameters which are transmitted via the channel to the decoder. The other parameters of subframes include either the adaptive VQ code (PS) or first sequence ($MS_0$), the second sequence ($MS_1$), pulse amplitude quantizer scaling, and switch indicator. For a 4 Kbps speech coder based on the model in one embodiment of the present invention, the number of bits allocated per parameter on a frame basis is as follows: 35 bits to represent the ten LPC coefficients; (11 bits)×(4 sub frames) to represent either PS or $MS_0$ (space=16 samples); (10 bits)×(4 subframes) to represent the second sequence (space=32 samples); 4 bits for scaling; (1 bit)×(4 sub frames) to indicate the state of the PS/$MS_0$ switch; and a spare bit. This yields a total of 128 bits per frame. Given a frame duration of 32 milliseconds, the present invention compresses speech to a bit rate of 128 bits/32 msec=4 kbps. In fact, other bit allocation scheme and frame structure can be used in low bit rate speech coder with current invention.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. An apparatus for compressing a speech signal into a compressed speech signal that is represented by a plurality of parameters, comprising:

a time-varying digital filter for modeling a vocal tract, wherein a plurality of coefficients per frame specify a transfer function of the filter;

an excitation circuit coupled to the filter for generating an excitation signal as an input to the filter, wherein the excitation circuit generates an adaptive vector quantiser code, a first pulse sequence, and a second pulse sequence for a plurality of subframes, each of the first pulse sequence and the second pulse sequence having delta pulses with varying amplitudes and a time pattern constrained to be equally spaced with a prechosen value so that the first pulse sequence and the second pulse sequence are characterized by the phase and amplitudes of the delta pulses and wherein the second pulse sequence is non-switchable;

selection logic coupled to the excitation circuit for determining whether the adaptive vector quantiser code or the first pulse sequence better corresponds to the speech signal by using a normalized cross-correlation function;

a switch coupled to the excitation circuit for selecting between a first excitation mode characterized by the adaptive vector quantiser code and a second excitation mode characterized by a first pulse sequence according to the selection logic;

a combination circuit coupled to the switch for combining either the selected adaptive vector quantiser code plus the second pulse sequence or the first pulse sequence plus the second pulse sequence, wherein the parameters which are transmitted through a channel to a destination decoder include the plurality of filter coefficients, either the adaptive vector quantiser code or the first pulse sequence, the second pulse sequence, and a bit indicating the state of the switch in order to produce a switched multiple-sequence excitation modeling.

2. The apparatus of claim 1, wherein the first pulse sequence is comprised of a plurality of bits specifying a phase of a first pulse and amplitudes corresponding to the first pulse and any following pulses, wherein the pulses of the pulse sequence are equally spaced apart in time.

3. The apparatus of claim 1, wherein the number of bits allocated per parameter on a frame basis includes: 35 bits to represent ten linear predictive code filter coefficients; 44 bits to represent either the adaptive vector quantiser code or the first pulse sequence, whichever is selected; 40 bits to represent the second sequence; and 4 bits to indicate the state of the switch, to result in a bit rate of approximately 4 kbps.

4. The apparatus of claim 1, wherein the combiner circuit combines additional pulse sequences as a function of channel loading.

5. The apparatus of claim 1, wherein the pulse sequence is comprised of equally spaced pulses.

6. The apparatus of claim 5, wherein an optimal phase of a first pulse of the pulse sequence is determined according to a minimum mean-square error:

$$E=\sum_{n}\left(S_w(n)-\sum_{i=1}^{4} gli\, h[n-\text{phase}-(i-1)*16]\right)^2$$

Where:

$S_w(n)$ perceptually weighted original speech h(n) impulse response of the filter gli i=1, . . . ,4 pulse amplitudes in MS0 phase initial phase in MS0 or MS1 [, here from 0 to 15 or from 0 to 30 for example].

7. A method for compressing a speech signal into a compressed speech signal that is represented by a plurality of parameters, comprising the steps of;

modeling a vocal tract by using a time-varying digital filter, wherein a plurality of coefficients per frame specify a transfer function of the filter;

generating an excitation signal, an adaptive vector quantiser code, a first pulse sequence, and a second pulse sequence for a plurality of subframes, each of the first pulse sequence and the second pulse sequence having delta pulses with varying amplitudes and a time pattern constrained to be equally spaced with a prechosen value so that the first pulse sequence and the second pulse sequence are characterized by the phase and amplitudes of the delta pulses and wherein the second pulse sequence is non-switchable;

inputting the excitation signal is to the filter;

determining whether the adaptive vector quantiser code or the first pulse sequence better corresponds to the speech signal by using a normalized cross-correlation function;

selecting between a first excitation mode characterized by the adaptive vector quantiser code and a second excitation mode characterized by a first pulse sequence according to the selection logic;

combining either the selected adaptive vector quantiser code plus the second pulse sequence or the first pulse sequence plus the second pulse sequence, wherein the parameters which are transmitted through a channel to a destination decoder include the plurality of filter coefficients, either the adaptive vector quantiser code or the first pulse sequence, the second pulse sequence, and a bit indicating the state of the switch in order to produce a switched multiple-sequence excitation modeling.

8. The method of claim 7, wherein the first pulse sequence is comprised of a plurality of bits specifying a phase of a first pulse and amplitudes corresponding to the first pulse and any following pulses and wherein the pulses of the pulse sequence are equally spaced apart in time.

9. The method of claim 7, wherein the number of bits allocated per parameter on a frame basis includes: 35 bits to represent ten linear predictive code filter coefficients; 44 bits to represent either the adaptive vector quantiser code or the first pulse sequence, whichever is selected; 40 bits to represent the second sequence; and 4 bits to indicate the state of the switch, to result in a bit rate of approximately 4 kbps.

10. The method of claim 7 further comprising the step of combining additional pulse sequences as a function of channel loading.

11. The method of claim 7, wherein the pulse sequence is comprised of equally spaced pulses.

12. The method of claim 7, wherein an optimal phase of a first pulse of the pulse sequence is determined according to a minimum mean-square error:

$$E = \sum_{n} \left( S_w(n) - \sum_{i=1}^{4} gli\, h[n - \text{phase} - (i-1) * 16] \right)^2$$

Where:

$S_w(n)$ perceptually weighted original speech h(n) impulse response of the filter gli i=1, . . ..4 pulse amplitudes in $MS_0$ phase initial phase in MS0 or MS1.

* * * * *